US007033256B2

(12) United States Patent
Miller

(10) Patent No.: US 7,033,256 B2
(45) Date of Patent: Apr. 25, 2006

(54) ABRASIVE FLUID JET MACHINING APPARATUS

(76) Inventor: Donald Stuart Miller, Brookside, Church Walk, Harrold, Bedford, Bedfordshire, MK47 7DG (GB)

( * ) Notice: Subject to any disclaimer, the term of this patent is extended or adjusted under 35 U.S.C. 154(b) by 0 days.

(21) Appl. No.: 10/693,254

(22) Filed: Oct. 24, 2003

(65) Prior Publication Data

US 2004/0132389 A1 Jul. 8, 2004

Related U.S. Application Data

(63) Continuation of application No. PCT/GB02/01835, filed on Apr. 25, 2002.

(30) Foreign Application Priority Data

Apr. 25, 2001 (GB) ..... 0110134

(51) Int. Cl.

| | |
|---|---|
| ***B24C 7/00*** | (2006.01) |
| ***F16K 31/143*** | (2006.01) |
| ***F16K 31/363*** | (2006.01) |
| ***F16K 31/383*** | (2006.01) |
| ***F16K 25/00*** | (2006.01) |

(52) U.S. Cl. ..... 451/101; 251/62; 251/63; 251/318; 251/175

(58) Field of Classification Search ..... 451/101; 251/62, 63, 318, 175

See application file for complete search history.

(56) References Cited

U.S. PATENT DOCUMENTS

| | | | | |
|---|---|---|---|---|
| 2,318,360 | A * | 5/1943 | Benner et al. | 51/309 |
| 2,405,854 | A * | 8/1946 | Ruemelin | 451/101 |
| 3,419,220 | A * | 12/1968 | Goodwin et al. | 239/591 |
| 3,626,841 | A * | 12/1971 | Schachter | 451/90 |
| 3,629,976 | A * | 12/1971 | Carpenter, Jr. | 451/101 |
| 3,704,553 | A * | 12/1972 | Hehr et al. | 451/101 |
| 4,569,161 | A * | 2/1986 | Shipman | 451/99 |
| 4,920,841 | A * | 5/1990 | Johnson | 83/177 |
| 5,184,434 | A | 2/1993 | Hollinger et al. | 451/36 |
| 5,186,393 | A | 2/1993 | Yie | 239/583 |
| 5,215,942 | A * | 6/1993 | MacKenzie et al. | 501/12 |
| 5,283,991 | A * | 2/1994 | Keizers | 451/101 |
| 5,605,497 | A * | 2/1997 | Pickard | 451/90 |
| 6,276,993 | B1 * | 8/2001 | Miller | 451/40 |

FOREIGN PATENT DOCUMENTS

| | | |
|---|---|---|
| EP | 0884509 A | 12/1998 |
| EP | 0884509 A1 * | 12/1998 |
| WO | WO 9914015 | 3/1999 |

* cited by examiner

*Primary Examiner*—Joseph J. Hail, III
*Assistant Examiner*—Bryan Muller
(74) *Attorney, Agent, or Firm*—Heslin Rothenberg Farley & Mesiti P.C.

(57) ABSTRACT

A valve for controlling a flow of abrasive particles suspended in a pressurized carrier fluid has at least two apertured valve seats (74, 75) in face to face contact. One of the valve seats (74, 75) may be slid between a first position in which the apertures of each valve seat (74, 75) are aligned to allow fluid flow and a second position in which the aperture is one valve seat (74, 75) is blocked by the face of another (75, 74) to stop flow through the valve. The valve seats (74, 75) each have an outer layer of material with a hardness on the Mohs scale of at least 9, such as diamond. The valve is suitable for use in a fluid jet machining apparatus, particularly apparatus charged with a suspension of abrasive particles such as garnet in water.

13 Claims, 6 Drawing Sheets

ABRASIVE FLUID JET MACHINING APPARATUS

CLAIM OF PRIORITY

This application is a continuation of International Patent Application No. PCT/GB02/01835 filed on Apr. 25, 2002, published in English on Nov. 7, 2002 as WO 02/087827, which claims priority to application No. GB0110134.4 filed in Great Britain on Apr. 25, 2001, the specification of each of which is incorporated herein by reference.

FIELD OF THE INVENTION

The present invention relates to the production and control of a flow of abrasive particles suspended in a pressurised carrier fluid for cutting materials such as metals, ceramics, polymers and composite materials. More particularly; but not exclusively, it relates to the production of a flow of particles of an abrasive, such as garnet, in an aqueous carrier fluid. The apparatus described is particularly suitable for operation at water pressures above 300 bar, feeding a suspension of fine abrasive particles in water to a cutting nozzle to produce a micro jet less than 100 μm (microns) in diameter.

BACKGROUND OF THE INVENTION

New micro-machining techniques are required to meet the growing demand for miniaturized products and processes. Abrasive waterjets have the potential to develop into an important micro-machining technique, but before this can happen new technologies are needed to generate and to control the flow of pressurised water flows carrying abrasive particles.

Micro-abrasive waterjets are formed by passing a pressurised suspension of abrasive particles in a fluid, generally water, through a ceramic or diamond cutting nozzle.

Abrasive suspensions can be provided pre-mixed, at the concentration required at the cutting nozzle, or alternatively abrasive particles can be metered from a bed of abrasive into a flow of fluid to a cutting nozzle.

Pre-mixed suspensions are normally formed by mixing abrasive particles and a suspending additive with water. A cartridge is filled with the suspension and is loaded into an abrasive storage vessel that forms part of the apparatus, or the suspension is caused to flow into an abrasive storage vessel. A pressurised source of water is then used to displace the abrasive suspension out of the abrasive storage vessel to a cutting nozzle. If sub micron abrasive particles or a viscous fluid is used, then a suspending additive may not be necessary. An abrasive storage vessel with a volume of one quarter of a liter contains sufficient suspension to cut for an hour with a 15 μm diameter nozzle operating with a water pressure of 700 bar.

When a micro-abrasive waterjet is to be fed with abrasive particles metered from an abrasive bed, the abrasive is first mixed with the fluid, usually but not necessarily water, and if needed, a Theological modifying additive. A cartridge is filled with the mixture and is loaded into an abrasive storage vessel or the mixture is caused to flow into an abrasive storage vessel. To carry out cutting about 10 percent or so of the flow from a pressurised source of fluid is diverted to the top of the abrasive storage vessel. The fluid flow into the abrasive storage vessel displaces a mixture of abrasive and fluid out of the outlet of the vessel, which mixes into the remaining 90 percent or so of the fluid that is flowing directly to the nozzle. A quarter liter abrasive storage vessel, containing a mixture with 70 percent abrasive by weight, can provide a suspension at a concentration of 10 percent abrasive to a 50 μm diameter nozzle for about one hour when cutting operations are carried out at 700 bar water pressure.

Cutting technologies using abrasive suspensions have been used in oil and gas well drilling and maintenance operations. Sand particles and/or particles of other materials are suspended in a water-based mud using bentonite and/or water soluble polymers, or in water using water-soluble polymers, and are pumped down a well to one or more relatively large cutting nozzles. More recently, U.S. Pat. No. 5,184,434 has described the use of similar water-soluble polymers in the generation of suspension abrasive waterjets for precision machining. For cutting operations with pre-mixed suspensions, an additive such as xanthan gum with shear-thinning characteristics is desired, so that it may hold abrasive particles in suspension when the suspension is not flowing, but not impede flow when cutting operations are in progress.

Oil well pumping equipment is large and robust and is capable of pumping abrasive suspensions. However, existing pumps for abrasive waterjet apparatus cannot handle abrasive suspensions in a satisfactory manner. An example of an apparatus that avoids pumping abrasive suspensions to generate abrasive waterjets is described in U.S. Pat. No. 5,184,434. It has valve arrangements to fill abrasive suspension storage vessels at low pressure and to discharge them at high pressure. The valves for such apparatus are required to open and close reliably with abrasive suspensions. However, valve technologies have not yet been available to build reliable valves for such apparatus.

International Patent Application WO 99/14015 (PCT/GB98/02627) describes apparatus suitable for producing micro abrasive waterjets.

The pressure differential imposed across settled beds of abrasive particles, with mean particle diameters greater than about 100 μm, causes water to percolate through the bed. Therefore, the mixture flowing out of the bed has a higher water content than is present in the bulk of the bed. Abrasive waterjets operating with settled beds of abrasive particles have relied on this water percolation for the bed to form and to aid in the flow of abrasive particles out of the beds. However, water percolation practically ceases with abrasive particle sizes needed for micro abrasive waterjets and this affects not only how beds can be formed, but also the time dependent rheological properties of abrasive beds and the structure of the beds during operation of abrasive waterjet apparatus.

Abrasive water mixtures of up to 70 percent by weight abrasive particles are used to form beds in apparatus to generate micro abrasive waterjets. Such mixtures exhibit complex, time dependent properties, such as thixotropy and hindered settling of particles. A bed may retain for several hours the characteristics of a freshly prepared mixture or may not reach a near fully settled state for many days. As particle sizes are reduced to micron and sub micron sizes, abrasive particle/water mixtures can begin to take on the properties of colloidal suspensions.

Polymer additives that are used to increase the viscosity of water are known to reduce the viscosity of mixtures with high ratios of abrasive particles to water. The additives affect the electrical charges of the particles and the interstitial water to allow easier movement between particles. Additives such as hydroxyethyl cellulose are known to prevent dewatering of abrasive particle/water mixtures by impeding the loss of water from abrasive beds.

Additives can be added to abrasive/water mixtures to provide benefits in operating abrasive waterjet apparatus. These benefits include:

a) Decreasing or increasing mixtures viscosity depending on the abrasive, water and additive concentrations, and on particle and additive properties;

b) Minimizing the-watering of the base of abrasive beds during cutting operations;

c) Aiding in the diffusion into abrasive beds of water entering the base of beds during pressurization of abrasive waterjet cutting apparatus and during abrasive on/off operations. This prevents the formation of vertical weakness in beds through which water can flow from the top to the bottom of a bed when only part of the bed has been discharged;

d) Maintaining desirable mixture characteristics for extended periods of time, particularly when abrasive is provided in cartridges that need a long shelf life; and e) Reducing the tendency for blockages to form in passages when conditions exist for abrasive particles to settle out, such as when the apparatus is not used fox an extended period of time and during upset conditions that cause high abrasive concentrations in passage.

As there is a need to produce abrasive waterjets with a wide range of particle diameters and to control the jet formation and cutting operations it would be beneficial to provide apparatus which can operate with freshly prepared abrasive water mixtures, with abrasive/water mixtures that contain rheological modifying agents, and which can feed cutting nozzles from both suspensions and beds of abrasive particles.

Water compressibility is a major factor in the design and control of an abrasive waterjet apparatus. The compressed water volume in the abrasive storage vessel can be the equivalent of over 10 seconds of water flow through the apparatus. Precise control of cutting demands that this is vented away from the nozzle, usually by depressurizing the apparatus. When an abrasive waterjet apparatus is depressurized, this compressed water is violently expelled from the abrasive storage vessel through conduits to a vent valve. If the expelled water contains abrasive particles, the sealing capabilities of the valve seats of conventional valves can be destroyed in a single venting operation. There is thus a need for a valve that can handle highly abrasive flows.

To depressurize and depressurize an abrasive waterjet apparatus between the end of one cut and the start of a new cut may takes several seconds which represents lost machining time. It would be desirable to provide a valve in the flow passage to the cutting nozzle in order to stop the discharge from the nozzle without having to depressurize the apparatus. With a valve in the connection to the nozzle it is not necessary to cycle the pressure in the apparatus from a high to a low pressure in order to stop flow from the nozzle. This has beneficial effects in reducing fatigue loads on apparatus, improving pump and component reliability and reducing energy use.

Without a shut off valve before the cutting nozzle, abrasive is discharged through the cutting nozzle in a poorly controller manner during pressurization of abrasive waterjet apparatus. Poor control over abrasive flow has adverse effects on the way jets penetrate into work pieces and in particular can cause local widening of the cut width and cause jets to deviate.

In order to extend the capabilities of abrasive waterjet cutting apparatus to carry out percussion drilling, milling and marking requires cutting jets to be turned on and off many times per second. An effective way of achieving rapid on/off capabilities is to have an on/off valve in the connection to the cutting nozzle or for the cutting nozzle to be an integral part of an on/off valve.

Being able to start and stop the flow to an abrasive waterjet cutting nozzle by opening and closing a valve simplifies the control system for an abrasive waterjet apparatus and reduces the incidence of nozzle blockages.

Also, in the apparatus described in International Patent Application WO 99/14015 and in this application, there is described a means of replenishing the abrasive storage vessel with abrasive mixture from another vessel. This requires valves that operate reliably on abrasive/water mixtures.

As described above there are many reasons why the operation of abrasive waterjet apparatus would benefit from valves that could operate reliably on abrasive/water mixtures. However, suitable valves have not heretofore been known.

There are two basic types of mechanical valve mechanisms, both of which involve a port or aperture in a member, referred to as a seat, and a valve element. In one type of valve the element moves along the axis of the seat and in the other the element, or a second seat, moves transversely to the seat.

Valves that involve elements that move along the axis of a seat are not suitable for use with fluids containing highly abrasive particles because of the brittle mature of the ultra hard materials needed to resist erosion. Substantial forces have to be applied to achieve a seal between an axially moving valve element and a seat. When brittle materials are forced together to stop the flow through a valve, point contacts occur that create local high contact forces and these forces cause fracture of brittle materials.

Thus, valves for highly erosive conditions need a mechanism involving a valve element moving more or less at right angles to a seat in such a way that abrasive particles cannot get between contacting surfaces. Ball valves and rotary disc type valves, with spring loaded elements to stop abrasive particles getting between contacting surfaces, have been developed for systems that operate with fluids that contain highly erosive particles.

However, such valves have limitations as regards apparatus to generate micro abrasive waterjets because:

a) Valve elements and seats cannot be easily fabricated from ultra hard materials to withstand wear if the valves are to be closed or opened under the high pressures in abrasive waterjet cutting apparatus;

b) The small size of the valve elements needed for micro abrasive waterjet apparatus makes it impractical to provide robust drive mechanisms that penetrate through pressure containments to actuate valve elements;

c) Sealing of valve element drive mechanisms, where they do pass through the pressure containment, is very difficult in the presence of the fine abrasive particles used in micro abrasive waterjet cutting; and d) The valves have flow passages that contain spaces where abrasive particles can accumulate and subsequently be released, when the sudden release of accumulated abrasive can cause cutting nozzles on abrasive waterjet apparatus to block.

It is therefore another object of this invention to provide two mating valve seats that slide relative to one another so that apertures in the seat can be aligned for flow to pass through the valve. Flow may be stopped by sliding the seats relative one to the other until the apertures no longer provide a flow path.

Although the valves will operate in the presence of abrasive suspensions, it is desirable that the amount of abrasive present during opening and closing of such valves is minimised. A means of momentarily stopping abrasive flow, in order that valves in the connection to the cutting nozzle may be operated in the presence of water alone, is described in International Patent Application WO 99/14015, and is incorporated into certain of the embodiments of the present invention.

Plunger pumps are conventionally used to power abrasive waterjet apparatus. Such pumps suffer from delivery pressure ripple. Pressure ripple can be minimised by synchronizing the motion of a plurality of pump plungers, as described in International Patent Application WO 99/14015, but some pressure ripple will always remain. Abrasive waterjet apparatus can function satisfactorily in cutting mode with a significant level of pressure ripple but problems arise when the abrasive flow out of an abrasive storage vessel is turned off by stopping the water flow into the top of the vessel. Water compressibility causes the abrasive storage vessel to act as a fluid accumulator, so a drop in pump delivery pressure, or an increase in pressure losses due to operating a valve to turn the abrasive off, causes abrasive to continue to flow out of the abrasive storage vessel.

There is thus a requirement for an apparatus and a method of operation thereof which may control or eliminate the adverse effects of such pressure variations. In the apparatus described, the pump delivery pressure is increased in a controlled manner when the abrasive off valve is operated. The pressure increase is greater than the sum of pressure variations caused by the pump and the pressure drop caused by operating the abrasive off valve, thereby ensuring that abrasive flow out of the abrasive storage vessel is stopped when the abrasive off valve is operated.

According to a first aspect of the present invention, there is provided a valve adapted to control a flow of abrasive particles suspended in a pressurised carrier fluid, comprising at least two apertured valve seat means each having a contact face in contact with a corresponding opposing contact face of another of said at least two apertured valve seat means and being translationally slideable in contact therewith and with respect thereto between a first position in which the apertures of each valve seat means are aligned so that fluid may pass through said apertures, and a second position wherein the aperture in one valve seat means is blocked by the contact face of another to stop flow through the valve, wherein the valve seat means each comprise an outer layer of material with a hardness, as measured on the Mohs scale, of at least 9.

Preferably there are provided two valve seat means, one being translationally slideable in contact with the other and with respect thereto.

Alternatively, there are provided three valve seat means, a median one of which being translationally slideable in contact with the outer ones and with respect thereto.

Advantageously, each of the valve seat means comprises diamond.

At least some of the valve seat means may comprise a composite diamond/ceramic material.

In this case, a median one of the valve seat means may comprise two layers of such composite material, with their ceramic faces brazed or otherwise joined together.

The valve may be provided with means to urge said valve seat means together.

The valve may comprise spring means adapted to urge the valve seat means one towards the other.

Additionally or alternatively, the means to urge the valve seat means towards one another may comprise the pressure of the carrier fluid exerted on one of the valve seat means.

In this case, the flow of abrasive particles and carrier fluid may pass to a seat means through a tube adapted to allow sliding movement of the seat means and to transmit thereto a force urging the seat means together.

The tube should withstand any buckling force.

The valve may be adapted to operate at a pressure of at least 1000 bar (100 MPa).

The abrasive particles may have a hardness of at least 6 Mohs.

The valve may be provided with slide means, to which one of the valve seat means is mounted, adapted to be moveable translationally by external actuating means, thereby causing said one valve seat means to move between said first and said second positions.

Advantageously, said external actuating means are pneumatic actuating means.

Optionally, said slide means may be configured to act as a piston means within a double-ended cylinder means provided with inlet means at each end for compressed actuating air.

Turning means may be provided to rotate at least one of said valve seat means and/or its slide means in relation to the other.

The valve may have a single inlet means leading to the aperture in one valve seat means and a single outlet means leading from the aperture in the other valve seat means, the valve containing as a result no dead spaces where abrasive particles may accumulate.

One or each valve seat means may have a contact face grooved to allow replenishment of a lubricating molecular water layer between the contact faces.

Additionally or alternatively, one or each valve seat means may comprise porous polycrystalline diamond so that a flow of water may penetrate the or each valve seat means sufficient to lubricate the contact surface between the valve seat means.

Advantageously, there is provided a container assembly adapted to contain supply of abrasive particles for use in an abrasive fluid jet machining apparatus, said assembly comprising a container for said abrasive particles closeable sealably by means of a cap, said cap comprising an inlet means connected to a riser tube within said body, each of such restricted bore as substantially to prevent liquid flow therethrough, except under an imposed pressure differential, and an outlet means, the bore of which comprises such a restriction as substantially to prevent flow therethrough, except under an imposed pressure differential.

Hence, the inlet means and outlet means are adapted to resist liquid flow out of the container assembly in the absence of sealing means.

The cap may comprise a substantially circular end face and said outlet means is disposed substantially centrally thereof.

Advantageously, said inlet means is disposed substantially flush to an end face of said cap.

The riser tube may extend from an inner face of said cap to a point adjacent but not in contact with a remote end of the container.

The container may contain a supply of abrasive particles suspended in a carrier fluid.

Alternatively, the container may contain a supply of abrasive particles immersed in a carrier fluid to form a bed of abrasive particles, adapted initially to occupy approximately 90% of the body of the container.

Preferably, an upper end of said riser tube is disposed above said bed when the container assembly is oriented with the cap at a lower end thereof.

The preferred carrier fluid is water.

In this case, the bed of abrasive particles additionally comprises a water-retention aid.

Advantageously, said abrasive particles comprise particles of garnet, olivine or aluminum oxide.

Optionally, said abrasive particles may have a mean particle diameter of between 10% and 50% of the diameter of the nozzle. The mean particle diameter may be less than 10 μm.

According to a second aspect of the present invention, there is provided an apparatus for machining a workpiece, comprising pressurizing means, a storage vessel for a supply of abrasive particles, a nozzle, and a valve as described above adjacently upstream of the nozzle, adapted to interrupt flow through the nozzle.

The pressurizing means may further comprise means momentarily to increase the pressure at a point between the nozzle and the storage vessel prior to actuation of the valve to interrupt flow through the nozzle.

The pressure at said point may be raised to a level exceeding that present in the storage vessel.

The apparatus may include valve means openable to cause an increased proportion of the fluid to flow from the pressurizing means directly to the point.

The apparatus may comprise means to control the pressurizing means to vary the delivery pressure.

BRIEF DESCRIPTION OF THE DRAWINGS

Embodiments of the invention will now be more particularly described by way of example and with reference to the accompanying drawings, in which.

DETAILED DESCRIPTION

Figure 1:
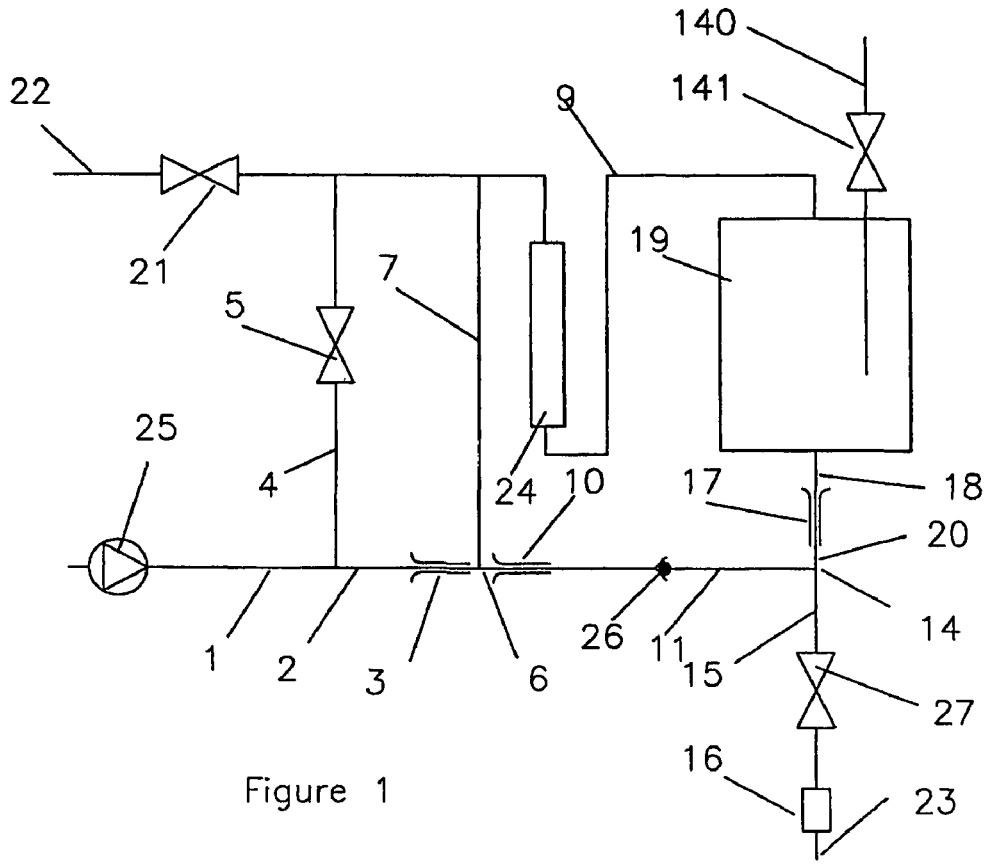
FIGS. 1 to 3 show alternative flow circuits for abrasive waterjet apparatus.

Referring now to the drawings, and to FIG. 1 in particular, a flow circuit is shown similar to that disclosed in International Patent Application WO 99/14015, with the addition of a buffer volume 24, a non return valve 26 and a shut-off valve 27. Buffer volume 24 is not necessary if valve 21 is not damaged by abrasive laden flows.

Pressurised water from a pump 25 enters the apparatus through conduit 1. When valve 5 is open, a major proportion of the water passes through conduit 4 and valve 5 and thence, via conduit 7, to a junction 6, where it recombines with a small proportion of the water flow which has passed through conduit 2 and a first restrictor 3. Of the total flow from the pump 25, about ninety percent flows from junction 6, through a second restrictor 10 and conduit 11, which is provided with a non-return valve 26, to junction 14, bypassing an abrasive storage vessel 19. The remaining ten percent or so of the water flows through the buffer volume 24 and conduit 9 to the storage vessel 19, where it displaces abrasive particles and water out of the bottom of the storage vessel 19 through conduit 18, an abrasive flow restrictor 17 and conduit 20 to junction 14. At junction 14, the flow from the storage vessel 19 joins the ninety percent or so of the flow that bypassed the storage vessel 19. From junction 14 the water and abrasive particles pass through conduit 15, which is provided with a shut-off valve 27, to a cutting nozzle 16, where the pressure energy of the fluid is converted to velocity energy to form an abrasive fluid jet 23. The percentage of water that flows to the top of the abrasive storage vessel 19 depends mainly on the cross-sectional areas of the restrictors 10 and 17 and conditions within the abrasive bed in the abrasive storage vessel 19.

When valve 5 is closed all the flow from conduit 1 passes through the first restrictor 3 across junction 6 and into the second restrictor 10. The combination of the first restrictor 3 and the second restrictor 10 forms a jet pump. This results in the static pressure in conduit 11 being higher than in conduit 7, causing flow to reverse in the abrasive storage vessel 19 as fluid from conduit 7 is entrained into the jet from the first restrictor 3 at junction 6. Abrasive flow to the nozzle 16 is therefore stopped by the closing of valve 5 and turned on by opening valve 5, while clean water flow continues.

When required, the whole apparatus may be depressurized by opening the vent valve 21.

The buffer volume 24 prevents abrasive particles carried out of the abrasive storage vessel 19 during depressurization of the apparatus from reaching the vent valve 21. The clean water flow to the top of the abrasive storage vessel 19 during pressurization of the vessel and during normal cutting operations flushes abrasive particles back from the buffer volume 24 into the abrasive storage vessel 19.

The non-return valve 26 provided in conduit 11 prevents abrasive particles from the base of storage vessel 19 from reaching the vent valve 21 during depressurization of the apparatus.

Vessel 19 can be replenished with abrasive using cartridges as described in International Patent Application WO 99/14015, the specification of which is incorporated by reference, or through conduit 140 and valve 141.

The shut-off valve 27, located in conduit 15 upstream of the nozzle 16, is used to stop flow from the nozzle 16. Before closing the shut-off valve 27, valve 5 is closed. After a short delay for the resulting clean water flow to clear abrasive from conduit 15, valve 27 is then closed.

If the pressure drop across the restrictor 3 is too high and/or if the delivery pressure from the pump 25 is decreasing, for instance due to pressure ripple, abrasive flow out of the abrasive storage vessel 19 may not immediately stop on closing valve 5. The pump 25 will usually be provided with two or more plungers powered by pneumatics, hydraulics or linear electric actuators. These methods of actuation allow the pump pressure to be rapidly varied. By increasing the delivery pressure from the pump 25 in a controlled manner when valve 5 is closed, flow out of the abrasive storage vessel 19 to junction 14 can be stopped controllably. Valve 27 can then be closed, or nozzle 16 can be moved rapidly from the end of a completed cut to the start of a new cut with only water discharging from the nozzle. In the new cutting position, cutting is restarted by opening valve 27 (if it has been closed), opening valve 5 and reducing the water pressure from the pump 25 to the normal cutting pressure. During this brief period of decaying water pressure, the abrasive concentration at the nozzle 16 is higher than the steady state cutting concentration. This higher abrasive concentration is beneficial in enabling a jet to make an initial penetration into the material being cut.

The operation of the flow circuit shown in FIG. 1, using a jet pump arrangement, begins to break down as nozzle diameters are reduced to the point where laminar flow occurs in parts of the circuit. It is then more appropriate to use the flow circuit of FIG. 2 which shows the circuit for a basic abrasive waterjet apparatus. A limitation of the circuit shown is its inability to stop abrasive discharge controllably. Any drop in delivery pressure from the pump 25 with valve 5 closed causes flow out of the bottom of the abrasive storage vessel 19. This flow has a high concentration of abrasive, which can settle out and block conduit 15 and nozzle 16. Hence it is preferred to use the circuit with a control strategy that increases the pump delivery pressure when valve 5 is closed. With increasing pump delivery pressure water flows back up conduit 18 into the base of the abrasive storage vessel 19, stopping the flow of abrasive to the nozzle 16. The nozzle 16 can then be moved rapidly from the end of a completed cut to the start of a new cut with only water discharging, or if a shutoff valve 27 is fitted, the shut-off valve 27 can be safely closed with only water passing therethrough.

Figure 3:
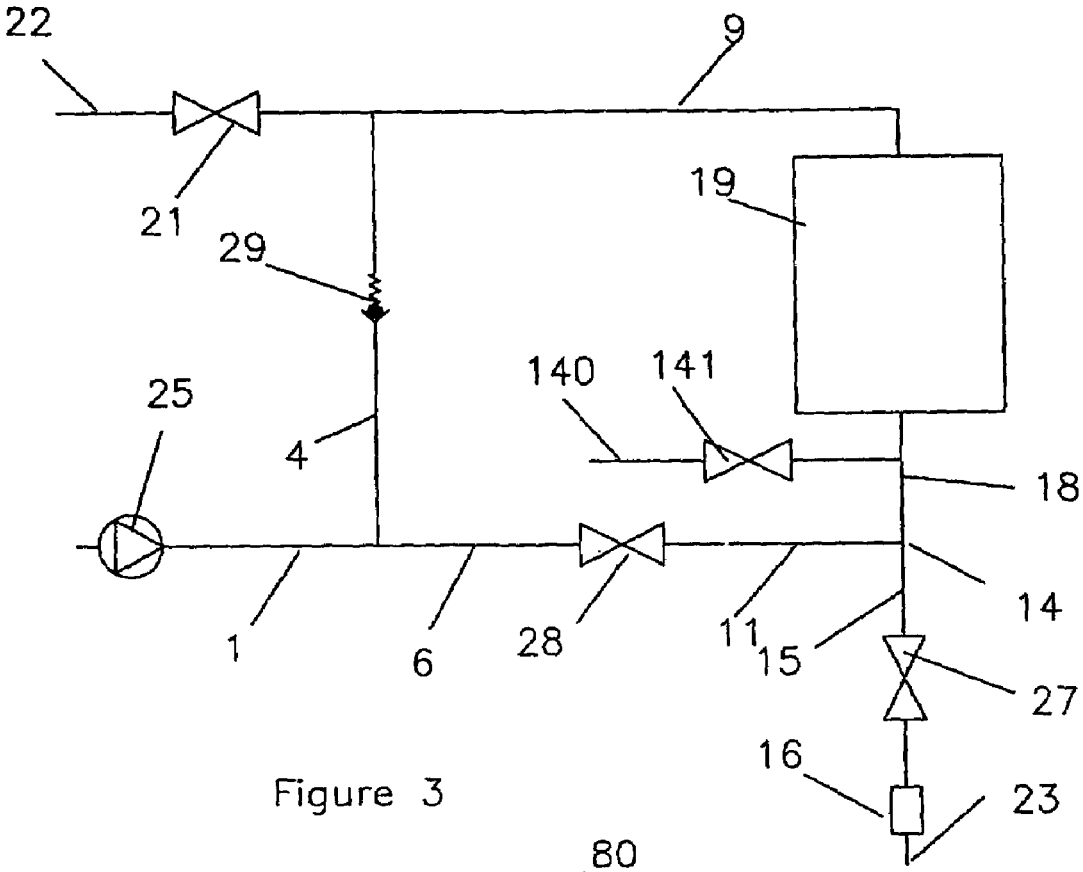

FIG. 3 shows a flow circuit for operating an apparatus in which the abrasive storage vessel 19 contains a suspension of abrasive particles at the same abrasive water weight ratio as is required at the nozzle 16. In the circuit shown in FIG. 3, the non return valve 29 is spring-loaded to give a pressure drop greater than the pressure ripple from pump 25. When valve 28 is open all the water entering conduit 1 flows to the nozzle 16. When valve 28 is closed the spring-loaded non-return valve 26 opens and fluid flows to the top of the abrasive storage vessel. Opening valve 28 causes valve 26 to close and the pressure to rise at junction 14, and this stops or reverses the flow out of abrasive storage vessel 19.

When vessel 19 is replenished with abrasive suspensions through conduit 140 and valve 141, the vessel may be provided with a floating piston to separate water entering through conduit 9 from mixing with the abrasive suspension in the vessel 19.

Abrasive concentrations in the abrasive storage vessel 19 can be varied from about seventy percent by weight of abrasive in water, down to less than ten percent. By adjusting the sizes of the restrictors 3, 10, 17 in the circuits shown in FIGS. 1 and 2, a wide range of abrasive to water ratios can be achieved at the nozzle 16 for a given ratio present in the abrasive storage vessel 19 and a specific rheological condition of the mixture. The maximum abrasive concentration that can be passed through the nozzle 16 depends on the abrasive particle size. With particle diameters less than a tenth of the nozzle diameter, abrasive concentrations up to fifty percent by weight can be made to flow through the nozzle 16, although cutting performance tends to be poor with such high abrasive concentrations. Concentrations of the order of ten percent by weight of abrasive provide a good compromise between cutting speed and efficient use of abrasive. When cutting speed is the main consideration the abrasive concentration can be increased to 20 to 30 percent.

Figure 4:
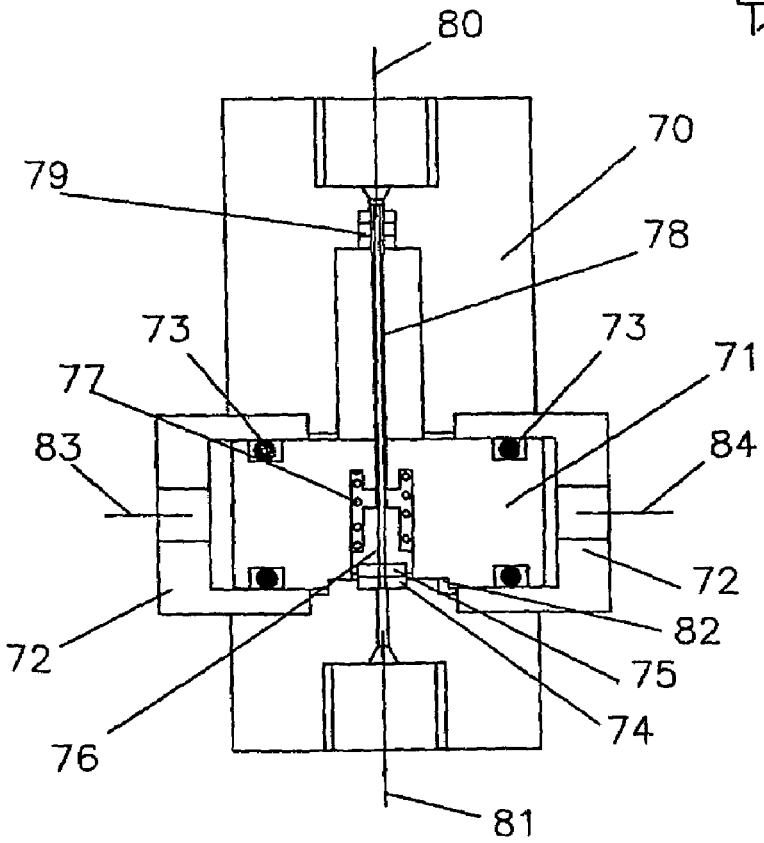
FIG. 4 shows a cross-section of a shut-off valve.

FIG. 4 shows a form of valve suitable for closing off conduits carrying high pressure fluids and in particular fluids transporting abrasive particles. Different forms of the valve can be used-as valve 5 of FIGS. 1 and 2; as valve 21 of FIGS. 1 to 3; as valve 28 of FIG. 3; as valve 141 of FIGS. 1 to 3; and most importantly as valve 27.

With the valve open, fluid enters through an inlet connection 80, and passes through a tube 78, and a pair of valve seats 75 and 74, to an outlet connection 81. Apertures are provided in each valve seat 74, 75 which are aligned in an open position of the valve, allowing fluid to pass therethrough. To shut off the fluid flow, a first valve seat 75 is slid over a second valve seat 74 to a position in which the aperture through the first seat 75 is sealed off by a face of the second seat 74. The seats 74 and 75 are made of an ultra hard, low friction material, such as polycrystalline or chemical vapor deposition diamond that has a flat polished surface. A spring 77, acting on a carrier 76 for the first seat 75, loads the seats 74, 75 together. When the fluid in the inlet connection 80 is pressurised, the major load on the seats 74, 75 can be due to fluid pressure acting on the upper end of the tube 78. The tube 78 is supported by a seal assembly 79 mounted to a valve body 70, and is guided in a slide 71. The tube 78 maintains connection to the first valve seat 75, denying dead space, and acts as a strut under buckling. Its unsupported length is a compromise between the need to contain the system pressure, to avoid buckling and to avoid applying excessive side loads that could result in tipping of the first seat 75 relative to the second seat 74.

The diameter of tube 78 in the area of the seal assembly 79 can be increased or decreased to change the axial loading on the tube by pressure in the inlet connection 80.

In the embodiment shown in FIG. 4 two pneumatic cylinders 72, mounted to the valve body 70, carry the slide 71, which is provided with a plurality of seals 73, and effectively forms the piston for both of the pneumatic cylinders 72. Application of compressed air at ports 83 and 84 thus opens and closes the valve. Movement of the slide 71 could also be produced by other forms of actuation. The movement range of the slide 71 is limited by stops 82 provided on the body 70 and on the slide 71. The inlet connection 80 may be offset laterally from the outlet connection 81 by half the permitted movement range of the slide 71. The tendency for buckling of tube 78 may thereby be minimised.

Figure 2:
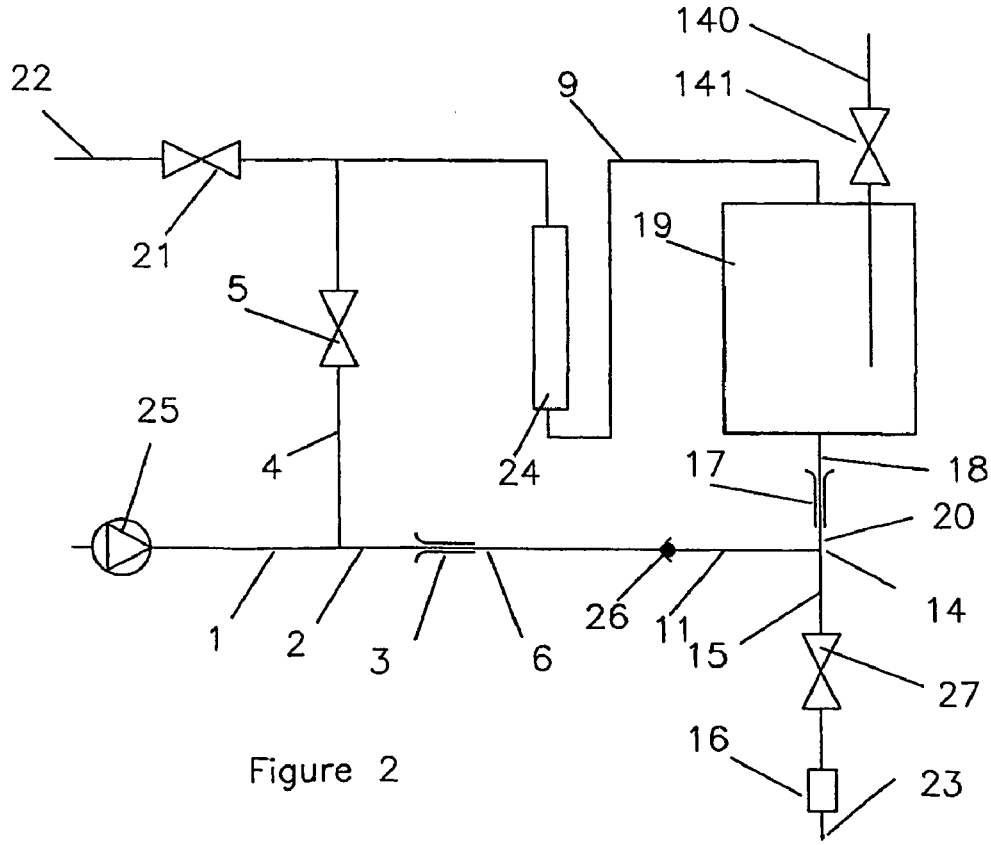
Figure 5:
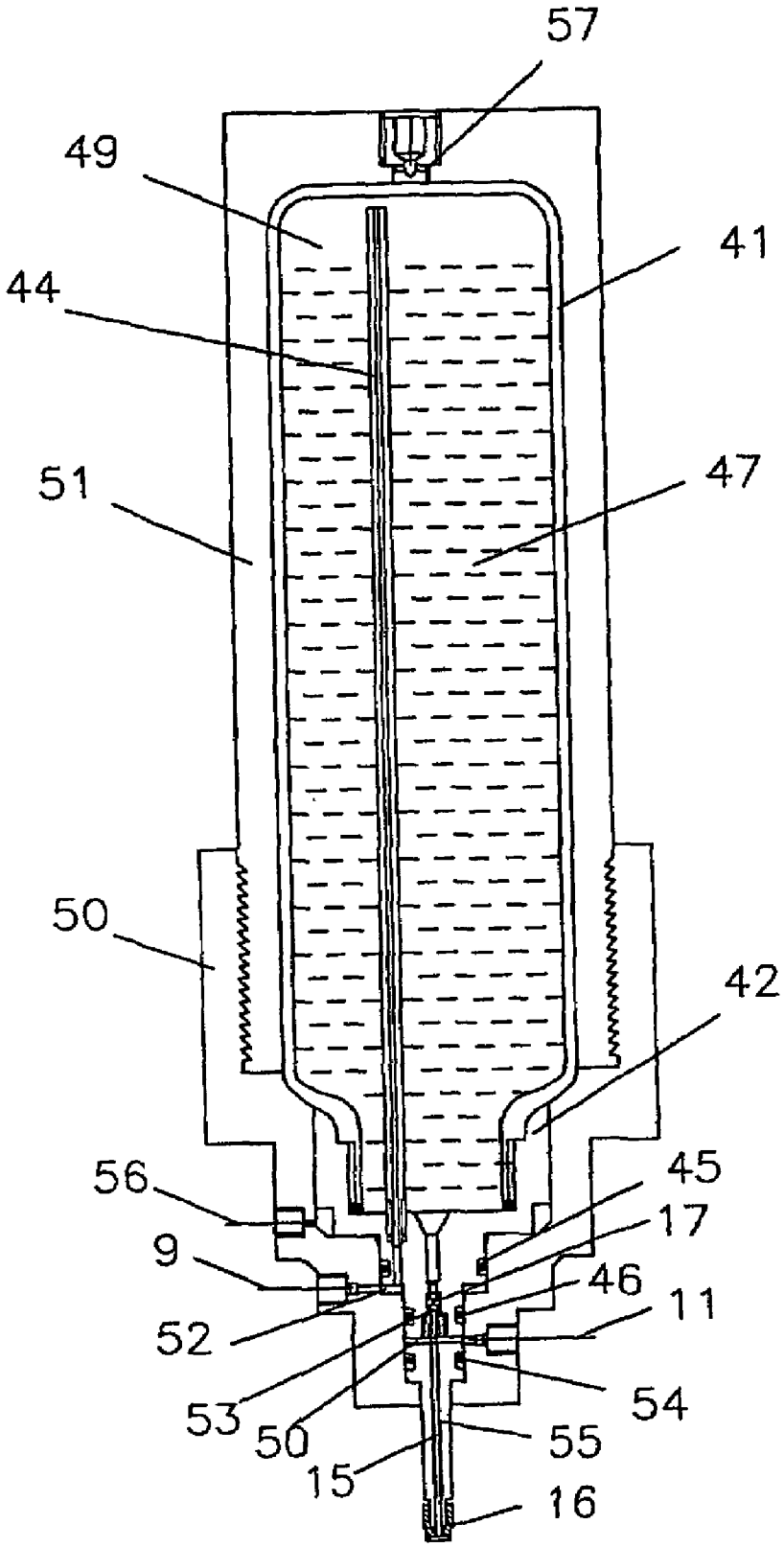
FIG. 5 shows a cross-section of an abrasive cartridge assembly.
Figure 6:
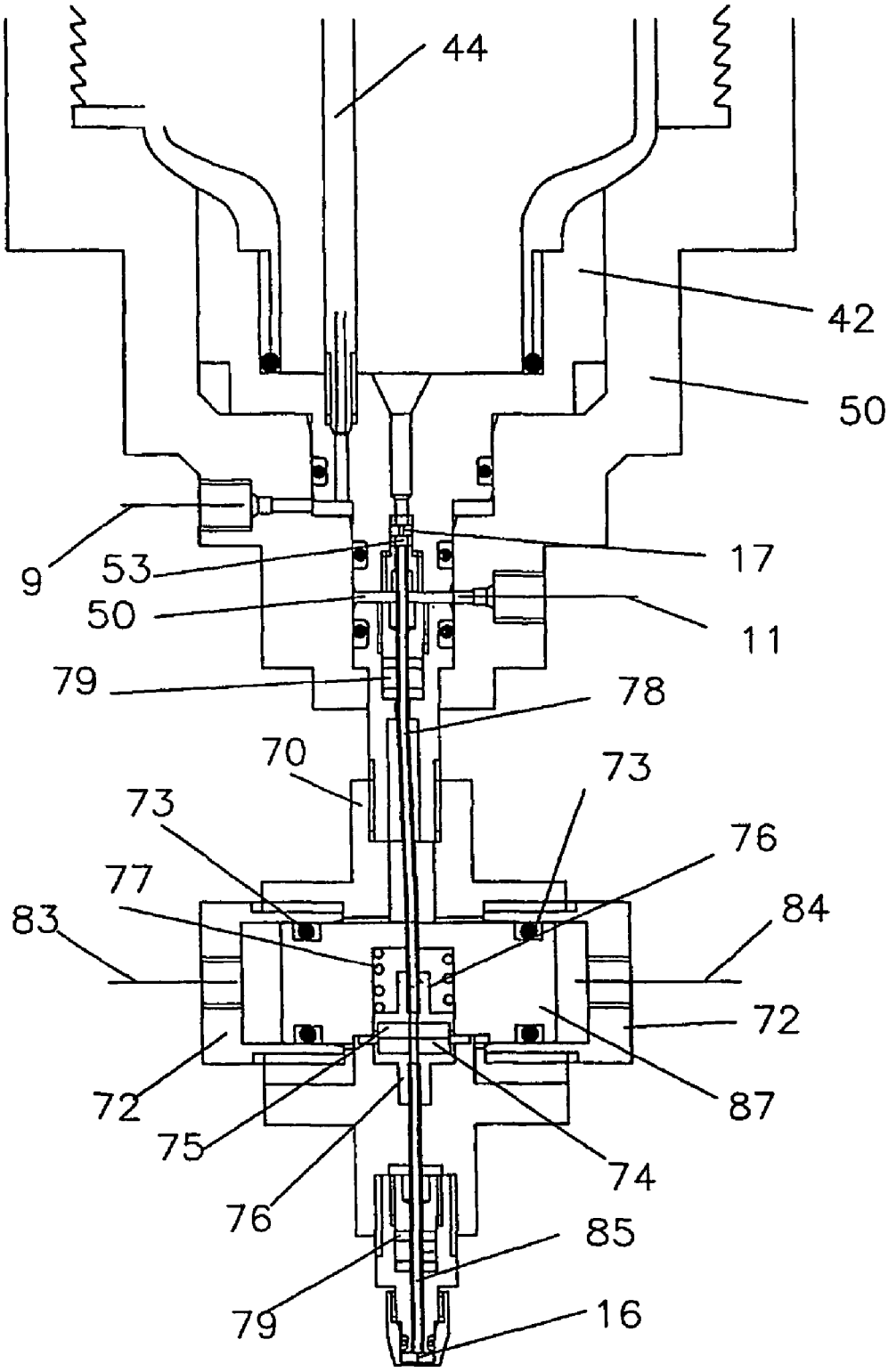
FIGS. 6 to 10 show cross-sections of alternative embodiments of a shut-off valve.

FIG. 6 shows a form of the valve installed at the base of an abrasive storage vessel 19, such as is shown in FIG. 5, which shows a cartridge assembly that can be installed in the abrasive storage vessels 19 of FIGS. 1 to 3. The cartridge assembly is formed by a cartridge 41, a cap 42, the abrasive flow restrictor 17, a riser tube 44 and two seals 45 and 46, and is installed in an abrasive storage vessel consisting of a pressure vessel made up of a barrel 51 and a base 50. As shown, the nozzle assembly made up of nozzle 16, extension 55, tube 15 and seal 54 is mounted in base 50.

Pressurised water entering through conduit 9 flows through passageways in the base 50 to an inlet plenum 52, formed between the base 50 and the cap 42, that is sealed by seals 45 and 46. The water enters a passage in the cap 42 that communicates with the riser tube 44, and discharges from the riser tube 44 into a water-filled volume 49 above a bed of abrasive 47. The flow of water into the cartridge assembly causes abrasive and water to flow out through the abrasive flow restrictor 17 into an outlet plenum 53, where they mix with water entering the outlet plenum 53 via conduit 11 and passageways in the base 50. The combined flow passes through conduit 15 to the cutting nozzle 16. During cutting operations, with an abrasive bed containing about seventy percent concentration by weight of abrasive, the water flow in conduit 9 is about ten percent of the water flow in conduit 11.

The bore of the abrasive flow restrictor 17 in the cap 42 is sized, in combination with restrictor 10 in the circuits feeding water to conduits 9 and 11, to regulate the water flows in order to achieve a particular abrasive concentration at the cutting nozzle.

The abrasive flow restrictor 17 in the cap 42 and the long narrow bore of the riser tube 44 both inhibit abrasive and water flow out of, and air flow into, the cartridge assembly while it is being fitted and removed from the base 50. This arrangement avoids the need for seals in the flow connections between the passageways in the base 50 and the cartridge cap 42, as are required in the abrasive storage vessel arrangements disclosed in International Patent Application WO 99/14015, the specification of which is incorporated herein by reference.

The arrangement shown allows one central physical connection to be used in place of the two physical connections used in the arrangement disclosed in the above International Patent Application. With only central physical connection cartridge assemblies are far easier to fit into the base 50 and no misalignment of connections is possible. The removal of cartridges from the base 50 can be aided by applying compressed air through conduit 56 once the barrel 51 is undone. Plug 57 in the barrel 51 provides a small annular gap between the plug and barrel, through which air can pass when the barrel is slid over the cartridge. The annular gap between plug 57 and the barrel 51 is sufficiently small that the cartridge 41 is not extruded into the gap when the apparatus is pressurised.

Figure 7:
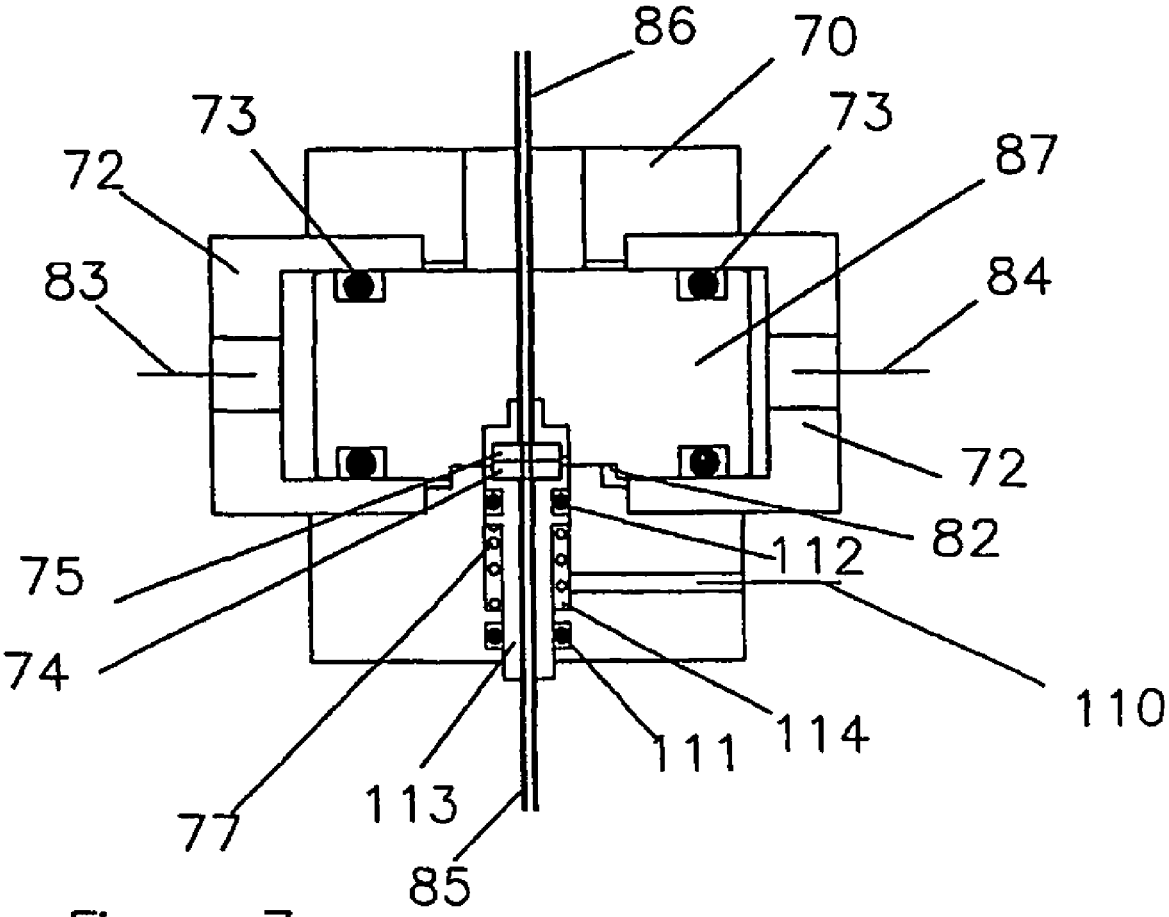

FIG. 7 shows a version of the valve shown in FIG. 4 that is particularly suited to applications in which one of the valve connections is to a low pressure region, such as the vent valve 21 of FIGS. 1 to 3. The valve exploits the flexible nature of the small diameter, high pressure tubing used to connect components of micro abrasive waterjet apparatus. Flow enters through a flexible inlet tube 86 to seat 75, and leaves through seat 74 and outlet tube 85. Seat 75 is mounted to slide 87. Seat 74 is located in carrier 113, which is loaded by a spring 77 to hold valve seats 75 and 74 together with a force that is typically 1.5 times the force exerted by the pressure in tube 86 acting on an area equal to the cross sectional area of the aperture in slide 89. Actuation of the valve follows that for the valve in FIG. 4. The force exerted by the spring 77 may be supplemented by fluid pressure from connection 110 acting on carrier 13 in plenum 114 formed between seals 111 and 112.

To avoid spring and fluid pressure loads on seats 74 and 75 causing the seats to tip relative to on another it is desirable to make the seat diameter larger than that required to achieve on and off operations. However, since the friction coefficient of diamond sliding on diamond more than doubles without a molecular film of water or other fluid at the sliding interface, patterns of grooves in the sliding faces of seats 74 and 75 can be used to allow replenishment of the molecular water layer. Porous polycrystalline diamond can also be used for seats 74 and 75 to allow a minute flow of water to escape and in the process lubricate the sliding interface of seats 74 and 75.

Figure 8:
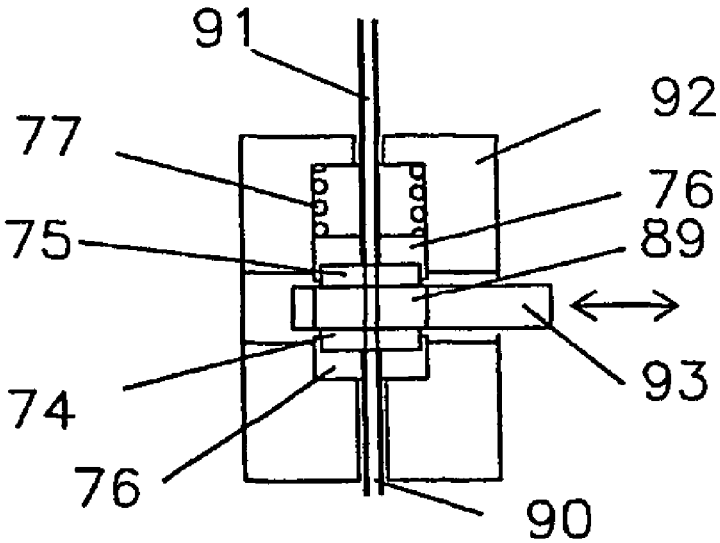

A form of the valve that is particularly suited to apparatus for feeding cutting nozzles less than about 50 μm diameter is shown in FIG. 8. The valve has a slide 93 separating the seats 74 and 75. The slide 93 has an aperture that can be moved into alignment with the apertures in seats 74 and 75 or to block off the connection between the apertures in seats 74 and 75. Spring 77 can provide the total sealing force on the seats 74 and 75 and slide 93, or part of the sealing force can come from axial loads on tube 78 of FIG. 4, or from fluid loading on carrier 76 as described in relation to FIG. 7.

The part of the slide 93 that moves relative to the seats 74 and 75 can take the form of a separate double faced seat 89 in the slide 93. Seat 89 can be rotated periodically along with seats 74 and 75 in order to even out the wear.

A robust slide for the valve in FIG. 8 can make use of diamond materials produced for diamond tipped tools for high speed machining. For instance the slide can be fabricated from items cut from a lapped disc of polycrystalline diamond, 0.5 mm thick on a 1 mm thick ceramic base. By brazing two pieces of material, ceramic to ceramic, 3 mm thick, diamond faced slides of sufficient strength can be produced. Machining of the composite diamond/ceramic material and its subsequent brazing and drilling uses techniques developed for diamond tipped tooling.

Figure 9:
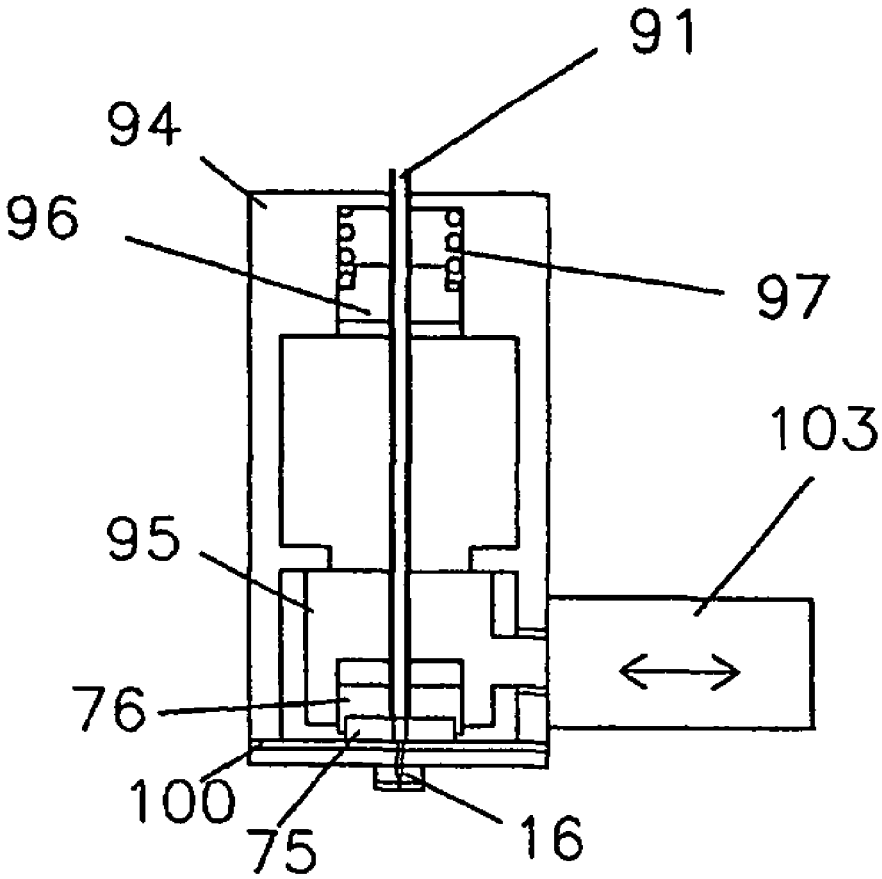

An ideal location to stop and start discharge through a nozzle is adjacent to the nozzle. FIG. 9 shows an arrangement of the valve where outlet seat 100 also acts as the nozzle 16. Fluid and suspended abrasive flows through tube 91 to seat 75 that is held in contact with seat/nozzle 100. Seat 75 can be slid laterally over seat/nozzle 100 by actuator 103 acting through member 95 and seat carrier 76 to align apertures in seat 75 and seat/nozzle 100 or to misalign the apertures to effect a seal. In the arrangement shown the spring 97 acting on collar 96 attached to tube 91 applies the sealing force between seat 75 and the seat/nozzle 100. Tube 91 deflects on movement of the seat 75 in a similar manner to tube 78 of FIG. 4.

As described in relation to the slide in FIG. 8 the seat/nozzle 100 can be a composite construction of diamond on ceramic discs brazed back to back, with the nozzle bore drilled through the outer diamond layer.

Figure 10:
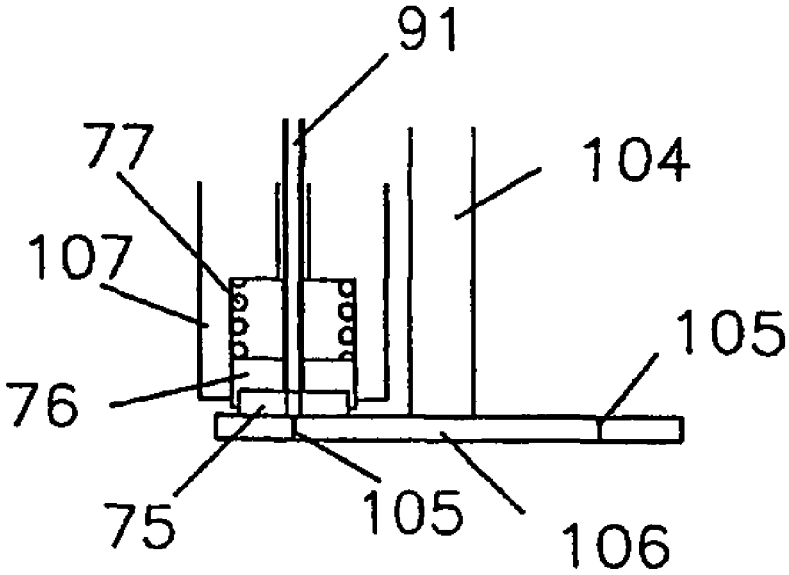

Another arrangement of valve integrated with the nozzle assembly is shown in FIG. 10. Multiple nozzles 105 are drilled in a diamond or diamond/ceramic disc 106 that is rotated by shaft 104 to align or not the nozzle drillings with the aperture in seat 75 that is connected to tube 91. A spring 77 can provide the total sealing force between seat 75 and the seat/nozzle 100 or part of the sealing force can come from axial loads on tube 91 in a similar manner to the fluid pressure load on tube 78 of FIG. 4.

As can be seen, the valve apertures are connected to tubes for carrying abrasive suspensions. The mating seats are made of ultra hard materials with a low coefficient of sliding friction, particularly of polycrystalline and carbon vapor deposition diamond, that can withstand highly erosive conditions and can move relatively freely under high loads. The valves have actuating mechanisms that do not pass through the pressure containment and the valve flow passages have no spaces where abrasive particles can accumulate.

Commercially available industrial diamond materials with highly polished, ultra flat surfaces can be used for the valve seats and components. Thus the valves are compact, economic to manufacture and can be actuated by linear and rotary drives, including advanced actuators based on shape memory alloys and piezoelectric transducers. Versions of the valve can make use of the cutting nozzle as one of the valve seats.

The invention claimed is:

1. A valve adapted to control a flow of abrasive particles suspended in a pressurized carrier liquid, the valve comprising:

at least two apertured valve seat means;

each said seat means having a contact face in contact with a corresponding opposing contact face of another said apertured valve seat means and being translationally slideable in contact therewith and with respect thereto between a first position in which the apertures of each valve seat means are aligned so that said pressurized carrier liquid is passable through said apertures, and a second position wherein the aperture in one valve seat means is blocked by the contact face on another to stop flow through the valve;

an elongate tubular strut means bearing at a first end thereof on a first of said valve seat means;

said valve seat means being urged sealingly together by the pressure of the carrier liquid exerted on a second end of the strut means remote from the first and transmitted generally longitudinally of the strut means to said first valve seat means;

the flow of abrasive particles and carrier liquid being passed to the valve seat means through said tubular strut means; and each said valve seat means comprising a material with a hardness, as measured on the Mohs scale, of at least 9.

2. A valve of claim 1 wherein the at least two apertured valve seat means comprise two valve seat means, one being translationally slideable in contact with the other and with respect thereto.

3. A valve of claim 1 wherein each of the valve seat means comprises diamond.

4. A valve of claim 1 wherein at least one of the valve seat means comprises a composite diamond/ceramic material.

5. A valve of claim 1 further comprising slide means to which one of the valve seat means is mounted, said slide means being adapted to be moveable translationally by external actuating means, thereby causing said one valve seat means to move between said first and said second positions.

6. An assembly comprising:

a valve adapted to control a flow of abrasive particles suspended in a pressurized carrier liquid, the valve comprising:

at least two apertured valve seat means;

each said seat means having a contact face in contact with a corresponding opposing contact face of another said apertured valve seat means and being translationally slideable in contact therewith and with respect thereto between a first position in which the apertures of each valve seat means are aligned so that said pressurized carrier liquid is passable through said apertures, and a second position wherein the aperture in one valve seat means is blocked by the contact face on another to stop flow through the valve;

an elongate tubular strut means bearing at a first end thereof on a first of said valve seat means;

said valve seat means being urged sealingly together by the pressure of the carrier liquid exerted on a second end of the strut means remote from the first and transmitted generally longitudinally of the strut means to said first valve seat means;

the flow of abrasive particles and carrier liquid being passed to the valve seat means through said tubular strut means;

and each said valve seat means comprising a material with a hardness, as measured on the Mohs scale, of at least 9; and a container assembly adapted to contain a supply of abrasive particles for use in an abrasive liquid jet machining apparatus, said assembly comprising a container for said abrasive particles closeable sealably by means of a cap, said cap comprising an inlet means connected to a riser tube within said container, each of such restricted bore as substantially to prevent liquid flow therethrough, except under an imposed pressure differential, and an outlet means, the bore of which comprises such a restriction as substantially to prevent flow therethrough, except under an imposed pressure differential.

7. An assembly of claim 6 wherein the container contains a supply of abrasive particles suspended in a carrier liquid.

8. An assembly of claim 7 wherein the carrier liquid is water, and said abrasive particles comprise particles selected from the group including garnet, olivine and aluminum oxide.

9. An apparatus for machining a workpiece, comprising pressurizing means, a storage vessel for a supply of abrasive particles, a nozzle, and a valve adapted to control a flow of abrasive particles suspended in a pressurized carrier liquid, the valve comprising at least two apertured valve seat means, each said seat means having a contact face in contact with a corresponding opposing contact face of another said apertured valve seat means and being translationally slideable in contact therewith and with respect thereto between a first position in which the apertures of each valve seat means are aligned so that said pressurized carrier liquid is passable through said apertures, and a second position wherein the aperture in one valve seat means is blocked by the contact face on another to stop flow through the valve, and elongate tubular strut means bearing at a first end thereof on a first of said valve seat means, said valve seat means being urged sealingly together by the pressure of the carrier liquid exerted on a second end of the strut means remote from the first and transmitted generally longitudinally of the strut means to said first valve seat means, the flow of abrasive particles and carrier liquid being passed to the valve seat means through said tubular strut means, and each said valve seat means comprising a material with a hardness, as measured on the Mohs scale, of at least 9, and said valve being located adjacently upstream of the nozzle, adapted to interrupt flow through the nozzle.

10. An apparatus of claim 9 wherein the pressurizing means further comprises means momentarily to increase the pressure at a point between the nozzle and the storage vessel to a level exceeding that present in the storage vessel to interrupt flow therefrom prior to actuation of the valve to interrupt flow through the nozzle.

11. An apparatus of claim 10 comprising valve means openable to cause an increased proportion of the liquid to flow from the pressurizing means directly to the point.

12. An apparatus for machining a workpiece, comprising pressurizing means, a storage vessel for a supply of abrasive particles, a nozzle, and a valve adjacently upstream of the nozzle, adapted to interrupt flow through the nozzle, said pressurizing means comprising means momentarily to increase the pressure at a point between the nozzle and the storage vessel to a level exceeding that present in the storage vessel to interrupt flow therefrom prior to actuation of the valve to interrupt flow through the nozzle, and said valve comprising:

at least two red valve seat means;

each said seat means having a contact face in contact with a corresponding opposing contact face of another said apertured valve seat means and being translationally slideable in contact therewith and with respect thereto between a first position in which the apertures of each valve seat means are aligned so that said pressurized carrier liquid is passable through said apertures, and a second position wherein the aperture in one valve seat means is blocked by the contact face on another to stop flow through the valve;

said valve seat means being urged sealingly together by the pressure of the carrier liquid exerted on one valve seat means; and each said valve seat means comprising a material with a hardness, as measured on the Mohs scale, of at least 9.

13. An apparatus of claim 12 comprising valve means openable to cause an increased proportion of the liquid to flow from the pressurizing means directly to the point.

* * * * *

UNITED STATES PATENT AND TRADEMARK OFFICE

CERTIFICATE OF CORRECTION

PATENT NO. : 7,033,256 B2
APPLICATION NO. : 10/693254
DATED : April 25, 2006
INVENTOR(S) : Miller It is certified that error appears in the above-identified patent and that said Letters Patent is hereby corrected as shown below:

Claim 12:
Col. 14, line 46, delete the word “red” and insert the word --apertured--.

Signed and Sealed this

Eleventh Day of July, 2006

JON W. DUDAS
*Director of the United States Patent and Trademark Office*